US009358424B1

(12) United States Patent
Childress

(10) Patent No.: US 9,358,424 B1
(45) Date of Patent: Jun. 7, 2016

(54) LOWER BACK STRETCHING DEVICE

(71) Applicant: Dallas Childress, Citrus Heights, CA (US)

(72) Inventor: Dallas Childress, Citrus Heights, CA (US)

( * ) Notice: Subject to any disclaimer, the term of this patent is extended or adjusted under 35 U.S.C. 154(b) by 0 days.

(21) Appl. No.: 14/684,692

(22) Filed: Apr. 13, 2015

(51) Int. Cl.
*A63B 23/00* (2006.01)
*A63B 23/02* (2006.01)

(52) U.S. Cl.
CPC ..... *A63B 23/0233* (2013.01)

(58) Field of Classification Search
CPC ..... A63B 22/00; A63B 22/0002; A63B 22/0007; A63B 22/0012; A63B 22/0015; A63B 22/0048; A63B 22/16; A63B 22/20; A63B 22/201; A63B 22/203; A63B 23/00; A63B 23/0233; A63B 23/0238
USPC ..... 482/131–137, 145, 148, 79–80, 90–91, 482/95–96, 140–143
See application file for complete search history.

(56) References Cited

U.S. PATENT DOCUMENTS 4,133,524 A * 1/1979 Barlew ..... A63B 21/00054 482/142
4,660,548 A * 4/1987 Bucher ..... A61H 23/0254 482/79
5,190,513 A * 3/1993 Habing ..... A63B 23/0211 482/140
D347,869 S * 6/1994 Friend ..... D21/685
5,538,487 A * 7/1996 Fulmer ..... A63B 21/0023 482/41
5,542,898 A * 8/1996 Wilkinson ..... A63B 21/0552 482/120
5,941,806 A * 8/1999 Olschansky ..... A63B 23/0222 482/132
6,080,090 A * 6/2000 Taylor ..... A63B 21/0455 482/121
6,203,473 B1 * 3/2001 Atwood ..... A63B 21/00047 482/142
6,699,162 B2 * 3/2004 Chen ..... A63B 21/4015 482/140
6,811,522 B1 * 11/2004 McQuinn ..... A63B 23/0233 128/845
7,442,153 B1 * 10/2008 Chasnov ..... A61H 1/0292 482/140
D613,804 S * 4/2010 Perez ..... D21/691
8,287,439 B2 10/2012 Evans et al.
8,366,590 B2 2/2013 Atnafe
8,734,304 B2 5/2014 Webber et al.
8,764,617 B2 * 7/2014 Teeter ..... A61H 1/0292 482/126
9,259,608 B2 * 2/2016 Beck ..... A63B 23/04
2012/0015786 A1 * 1/2012 Evans ..... A63B 23/0233 482/142
2013/0035217 A1 * 2/2013 Beck ..... A63B 23/04 482/79
2013/0210588 A1 * 8/2013 Derrick ..... A63B 21/068 482/96

* cited by examiner

*Primary Examiner* — Loan H Thanh
*Assistant Examiner* — Andrew S Lo
(74) *Attorney, Agent, or Firm* — Crossley & Stevenson IP Law

(57) ABSTRACT

A lower back stretching device which allows a user in a supine position with his buttocks supported by a cross-brace disposed between a pair of side panels and with his knees resting atop a height-adjustable knee support bar parallel to the cross-brace between the side panels to push and pull the forwardly angled handles of the device and rock the device back and forth on convex side panel bottom ends in order lift and stretch the user's lower back.

8 Claims, 4 Drawing Sheets

LOWER BACK STRETCHING DEVICE

BACKGROUND OF THE INVENTION

Various types of lower back stretching devices are known in the prior art. The lower back muscles can be stretched by lifting the chest from a ground surface from a face down position or by bending down from the waist and returning to an upright position. Lower back exercise machines are provided which permit a seated user to push against a back rest thereof and move from an upright or forwardly included position into a rearwardly reclined position with both the seat and a foot plate in a stationary position during use. However, what is needed and provided by the present device is a lower back stretching device which is not a machine, but instead is a self-operated device which allows a user in a supine position with his buttocks supported by a cross-brace between a pair of side panels and with his knees resting atop a height-adjustable knee support bar to push and pull the handles of the device to rock the device back and forth on the convex bottom ends of the side panels in order to lift and stretch his lower back.

FIELD OF THE INVENTION

The present invention relates to exercise devices, and more particularly, to a lower back stretching device.

SUMMARY OF THE INVENTION

The general purpose of the present lower back stretching device, described subsequently in greater detail, is to provide a lower back stretching device which has many novel features that result in a lower back stretching device which is not anticipated, rendered obvious, suggested, or even implied by prior art, either alone or in combination thereof.

To accomplish this, the present lower back stretching device allows a user to stretch his lower back to relieve lower back pain by including a pair of spaced-apart substantially scalene-triangular side panels conjoined in a parallel position relative each other and each of a parallelepiped cross-brace disposed at a rear side proximal a convex bottom end and a height adjustable knee support bar extending between the side panels. The knee support bar having a cushioned sleeve is adjustably positionable between an upper side of the cross-brace and the top end in a position parallel to the upper side of the cross-brace. Each of the cross-brace and the knee support bar has a width in a range of approximately 18 inches to 36 inches to accommodate a user's body in a supine position between the side panels.

The adjustment of the knee support bar is provided by an elongated vertical aperture disposed on each side panel. Each vertical aperture has an uppermost end disposed proximal the top end of the respective side panel and a lowermost end disposed between the knee support bar and proximal the upper side of the cross-brace. An outside end of each knee support bar engages one of a plurality of notches along the aperture of the respective side panel. A fastener removably attaches the outside end of each knee support bar within a respective one of the notches to the exterior wall of the respective side panel. By moving the knee support bar upwardly toward the top end and downwardly and fastening the knee support bar into place with the fastener, a distance between the knee support bar and the upper side of the cross-brace can be adjusted as needed to rest the user's knees comfortably over the knee support bar. A pair of parallel handles is attached directly to the exterior walls of the side panels at a forward angle relative the rear side. Each handle has an internal side, a lower end attached to the respective side panel, an upper end extending forwardly beyond the front side, a forward side, and a rearward side. The rearward side of each handle is disposed at an angle in a range of approximately 110 degrees to 130 degrees relative an edge of the side panel adjacent the rear side. In use, the cross-brace is positioned proximal the user's buttocks with the user in a supine position between the side panels and with both of the user's knees positioned atop and over the knee support bar. Then, the user alternately pulls and pushes the handles toward and away from the user's torso which, in turn, lifts and upwardly rolls the user's lower spine to open and stretch the lower back and lowers and downwardly rolls the lower spine, respectively, to relax and relieve pressure on the user's lower back. The convex bottom end of the side panels permits the device to rock back and forth when the handles are pulled to and pushed away from the user.

Thus has been broadly outlined the more important features of the present lower back stretching device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
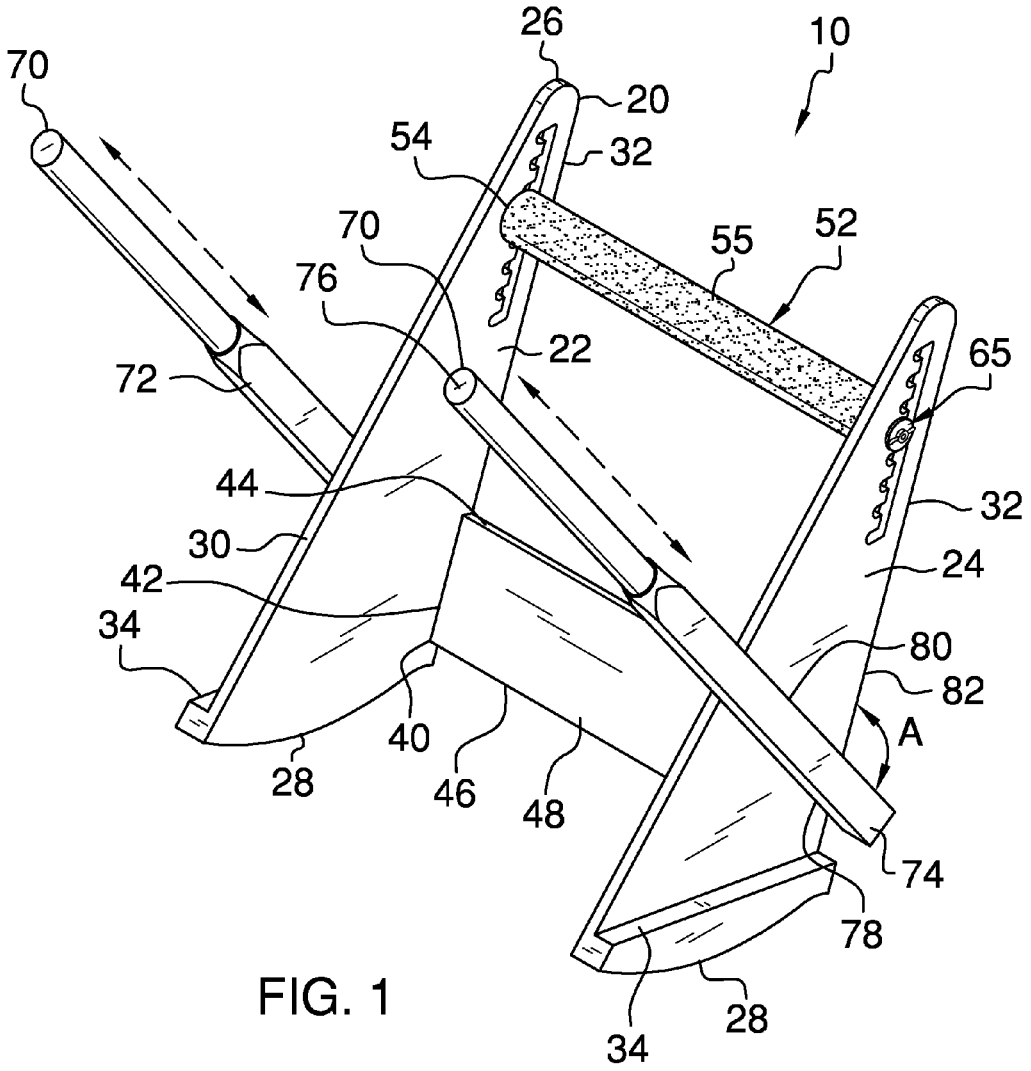
FIG. 1 is an isometric view.
Figure 2:
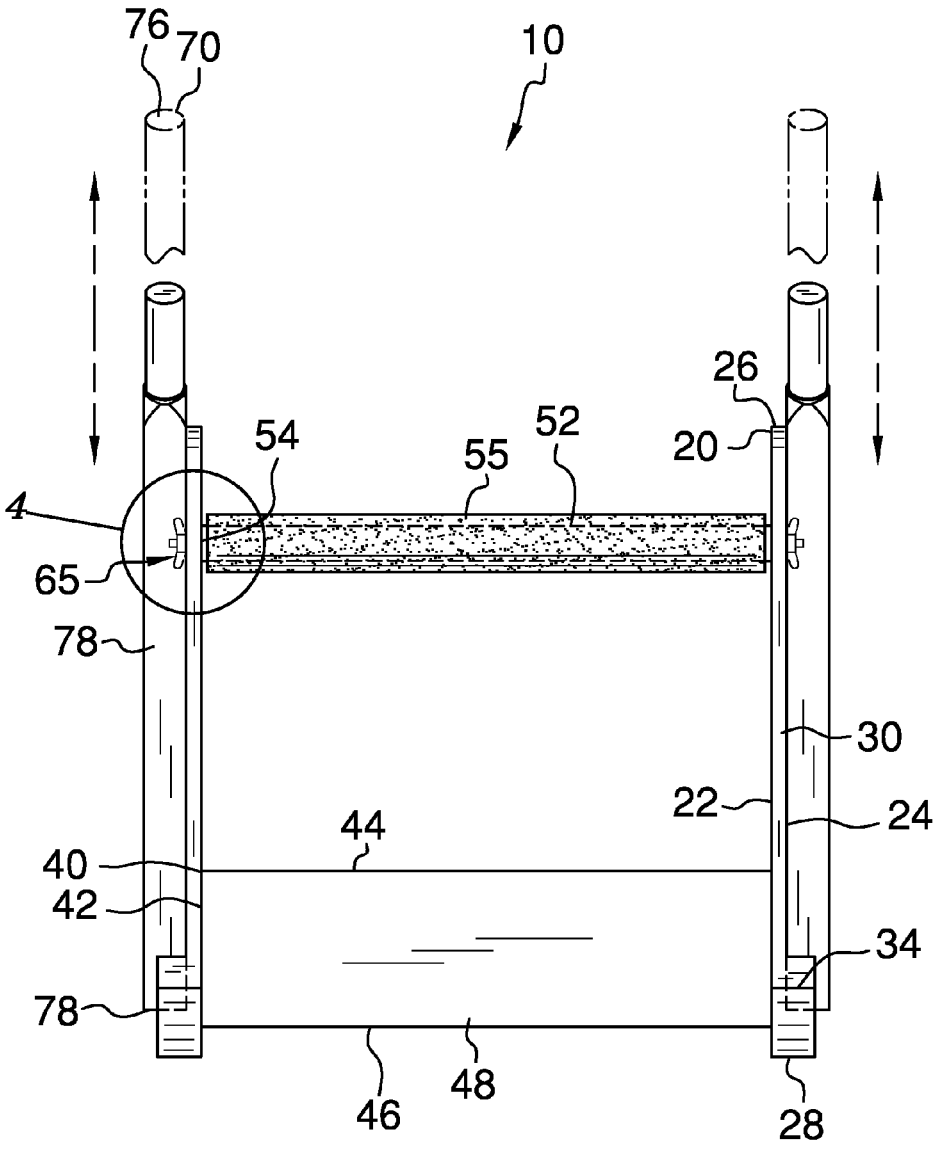
FIG. 2 is a front elevation view.

With reference now to the drawings, and in particular FIGS. 1 through 5 thereof, an example of the instant lower back stretching device employing the principles and concepts of the present lower back stretching device and generally designated by the reference number 10 will be described.

Referring to FIGS. 1 through 5 the present lower back stretching device 10 is devised to permit the stretching of an individual's accurately and consistently stretch to relieve lower back pain. The lower back stretching device 10 includes a pair of spaced-apart substantially scalene-triangular side panels 20 conjoined in a parallel position relative each other. Each side panel 20 has an interior wall 22, an exterior wall 24, a top end 26, a convex bottom end 28, a front side 30, and a rear side 32. The front side 30 has a length longer than a length of each of the rear side 32 and the bottom end 28. The length of the bottom end 28 is approximately one-third the length of the front side 30. A lip 34 is continuously disposed on the exterior wall 24 along the entire the bottom end 28.

A parallelepiped cross-brace 40 extends between the side panels 20 and has a pair of exterior ends 42 opposite each other, an upper side 44, a lower side 46, a to forward wall 48, and a rearward wall 50. Each exterior end 42 is disposed on the interior wall 22 of a respective side panel 20 at the rear side 32 in a position proximal the bottom end 28.

A cylindrical knee support bar 52 has a pair of external ends 54 opposite each other. Each external end 54 is disposed on the interior wall 22 of a respective side panel 20 at the rear side 32 in a position proximal the top end 26. The knee support bar 52 is adjustably positionable between the upper side 44 of the cross-brace 40 and the top end 26 in a position parallel to the upper side 44 of the cross-brace 40. A cushioned sleeve 55 is continuously disposed on each knee support bar 52 between the side panels 20.

Figure 4:
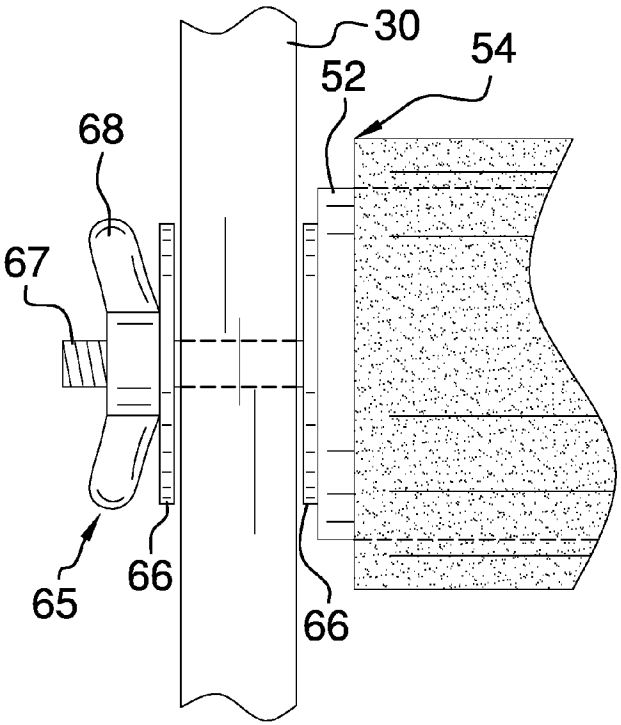
FIG. 4 is a detailed front elevation view taken from FIG. 2.
Figure 3:
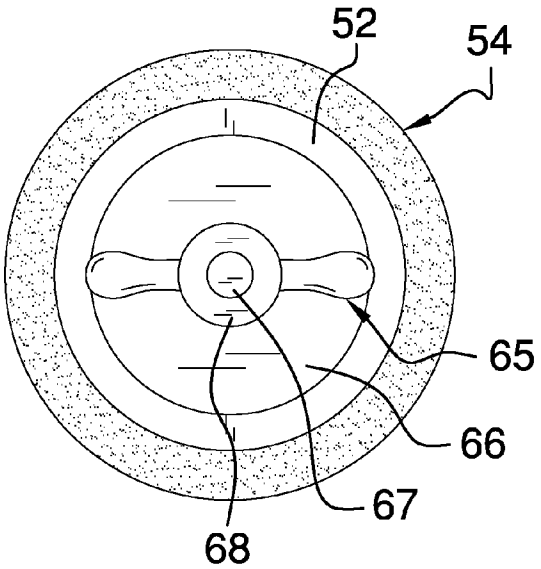
FIG. 3 is a detailed end view of a knee support bar and a fastener.
Figure 5:
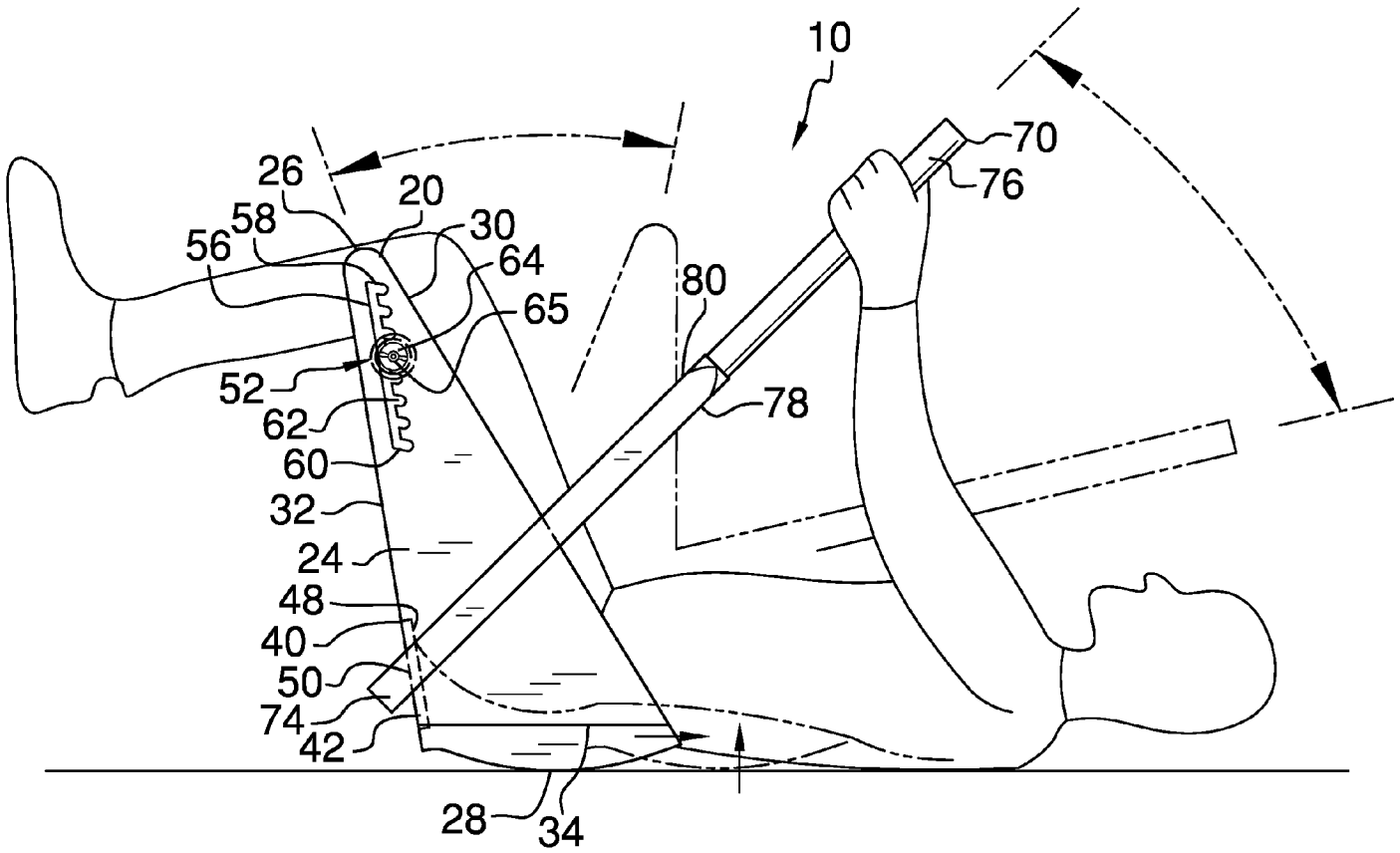
FIG. 5 is an in-use side elevation view.

The adjustment of the knee support bar 52 is provided by an elongated vertical aperture 56 disposed on each side panel 20. Each vertical aperture 56 has an uppermost end 58 disposed proximal the top end 26 of the respective side panel 20 and a lowermost end 60 disposed between the knee support bar 52 and proximal the upper side 44 of the cross-brace 40. A plurality of notches 62 along the aperture 56 of each side panel 20. The notches 62 are directed toward the front side 30. An outside end 64 of each knee support bar 52 engages one of the notches 62 along the aperture 56 of the respective side panel 20. Each of the cross-brace 40 and the knee support bar 52 has a width in a range of approximately 18 inches to 36 inches to accommodate a user's body in a supine position between the side panels. A fastener 65 removably attaches the outside end 64 of each knee support bar 52 within a respective one of the notches 62 to the exterior wall 24 of the respective side panel 20. As shown in FIG. 4, the fastener 65 can include at least one washer 66, a lag screw 67 and a thumb screw nut 68 in operational communication with each other. The fastener 65 can take other forms which are commensurate with the structure and functionality of the present device 10.

A handle 70, which can be telescopic, is attached directly to the exterior wall 24 of each side panel 20 at a forward angle relative the rear side 32. The handles 70 are parallel to each other. Each handle 70 has an internal side 72, a lower end 74 attached to the respective side panel 20, an upper end 76 extending forwardly beyond the front side 30, a forward side 78, and a rearward side 80. The rearward side 80 of each handle 70 is disposed at an angle A in a range of approximately 110 degrees to 130 degrees relative an edge 82 of the side panel 20 adjacent the rear side 32. To use the present device 10, the cross-brace 40 is positioned proximal the user's buttocks with the user in a supine position between the side panels 20 and with both of the user's knees positioned atop and over the knee support bar 52. Once in the foregoing described position, the user alternately pulls and pushes the handles 70 toward and away from the user's torso which, in turn, lifts and upwardly rolls the user's lower spine to open and stretch the lower back and lowers and downwardly rolls the lower spine, respectively to relax and relieve pressure on the user's lower back. A distance between the knee support bar 52 and the upper side 44 of the cross-brace 40 can be adjusted as needed to rest the user's knees comfortably over the knee support bar 52 by moving the knee support bar 52 upwardly toward the top end 26 and downwardly and fastening the knee support bar 52 between the side panels 20 into place with the fastener 65. The convex bottom end 28 of the side panels 20 permits the device 10 to rock back and forth when the handles 70 are pulled to and pushed away from the user.

What is claimed is:

1. A lower back stretching device comprising:

a pair of spaced-apart substantially scalene-triangular side panels conjoined in a parallel position relative to each other, each side panel having an interior wall, an exterior wall, a top end, a convex bottom end, a front side, and a rear side, wherein the front side has a length longer than a length of each of the rear side and the bottom end, wherein the length of the bottom end is approximately one-third the length of the front side;

a lip continuously disposed on the exterior wall along the entire length of the bottom end;

a parallelepiped cross-brace having a pair of exterior ends opposite each other, an upper side, a lower side, a forward wall, and a rearward wall, each exterior end disposed on the interior wall of a respective side panel at the rear side in a position proximal to the bottom end;

a cylindrical knee support bar having a pair of external ends opposite each other, each external end disposed on the interior wall of a respective side panel at the rear side in a position proximal to the top end, the knee support bar being adjustably positionable between the upper side of the cross-brace and the top end in a position proximal to the upper side of the cross-brace; and a handle attached directly to the exterior wall of each side panel at a forward angle relative to the rear side, the handles being parallel to each other, each handle having an internal side, a lower end attached to the respective side panel, an upper end extending forwardly beyond the front side, a forward side, and a rearward side;

wherein each of the cross-brace and the knee support bar has a width in a range of approximately 18 inches to 36 inches.

2. The lower back stretching device of claim 1 further comprising:

an elongated vertical aperture disposed on each side panel, each vertical aperture having an uppermost end disposed proximal to the top end of the respective side panel and a lowermost end disposed between the knee support bar and proximal to the upper side of the cross-brace;

a plurality of notches along the aperture of each side panel, the notches directed toward the front side;

an outside end on each opposing end of the knee support bar, wherein each of the outside end of the respective knee support bar engages one of the notches along the aperture of the respective side panel; and a fastener removably attaching the outside end on each opposing end of the knee support bar within a respective one of the notches to the exterior wall of the respective side panel.

3. The lower back stretching device of claim 2 wherein the rearward side of each handle is disposed at an angle in a range of approximately 110 degrees to 130 degrees relative to an edge of the side panel adjacent the rear side.

4. The lower back stretching device of claim 2 further comprising a cushioned sleeve continuously disposed on the knee support bar between the side panels.

5. The lower back stretching device of claim 3 further comprising a cushioned sleeve continuously disposed on the knee support bar between the side panels.

6. A lower back stretching device comprising:

a pair of spaced-apart substantially scalene-triangular side panels conjoined in a parallel position relative to each other, each side panel having an interior wall, an exterior wall, a top end, a convex bottom end, a front side, and a rear side, wherein the front side has a length longer than a length of each of the rear side and the bottom side, wherein the length of the bottom side is approximately one-third the length of the front side;

a lip continuously disposed on the exterior wall along the entire length of the bottom end;

a parallelepiped cross-brace having a pair of exterior ends opposite each other, an upper side, a lower side, a forward wall, and a rearward wall, each exterior end disposed on the interior wall of a respective side panel at the rear side in a position proximal the bottom end;

a cylindrical knee support bar having a pair of external ends opposite each other, each external end disposed on the interior wall of a respective side panel at the rear side in a position proximal to the top end, the knee support bar being adjustably positionable between the upper side of the cross-brace and the top end in a position parallel to the upper side of the cross-brace;

a cushioned sleeve continuously disposed on each knee support bar between the side panels;

an elongated vertical aperture disposed on each side panel, each vertical aperture having an uppermost end disposed proximal to the top end of the respective side panel and a lowermost end disposed between the knee support bar and proximal to the upper side of the cross-brace;

a plurality of notches along the aperture of each side panel, the notches directed toward the front side;

an outside end on each opposing end of the knee support bar, wherein each of the outside end of the respective knee support bar engages one of the notches along the aperture of the respective side panel;

a fastener removably attaching the outside end on each opposing end of the knee support bar within a respective one of the notches to the exterior wall of the respective side panel; and a telescopic handle attached directly to the exterior wall of each side panel at a forward angle relative the rear side, the handles being parallel to each other, each handle having an internal side, a lower end attached to the respective side panel, an upper end extending forwardly beyond the front side, a forward side, and a rearward side;

wherein each of the cross-brace and the knee support bar has a width in a range of approximately 18 inches to 36 inches.

7. The lower back stretching device of claim 6 wherein the rearward side of each handle is disposed at an angle in a range of approximately 110 degrees to 130 degrees relative to an edge of the side panel adjacent the rear side.

8. The lower back stretching device of claim 6 wherein the fastener comprises a pair of washers, a lag screw and a thumb screw nut in operational communication with each other, wherein one of the washers is disposed on each of the interior wall and the exterior wall of each respective side panel.

* * * * *